US011225852B2

(12) United States Patent
Shenoy et al.

(10) Patent No.: US 11,225,852 B2
(45) Date of Patent: Jan. 18, 2022

(54) PUMP THROUGH FUNCTIONALITY IN SUBSEA VALVES USING EXTERNAL MANIFOLD

(71) Applicant: OneSubsea IP UK Limited, London (GB)

(72) Inventors: Mahesh Shenoy, Katy, TX (US); John Kobersky, Alvin, TX (US); Christopher Irvine, Hamilton (GB)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 16/910,563

(22) Filed: Jun. 24, 2020

(65) Prior Publication Data

US 2020/0399986 A1 Dec. 24, 2020

Related U.S. Application Data

(60) Provisional application No. 62/865,474, filed on Jun. 24, 2019.

(51) Int. Cl.
*E21B 34/16* (2006.01)

(52) U.S. Cl.
CPC ..... *E21B 34/16* (2013.01); *E21B 2200/04* (2020.05)

(58) Field of Classification Search
CPC ..... E21B 34/16; E21B 2200/04
See application file for complete search history.

(56) References Cited

U.S. PATENT DOCUMENTS

| | | | | |
|---|---|---|---|---|
| 5,782,304 | A * | 7/1998 | Garcia-Soule | E21B 23/006 166/356 |
| 8,151,887 | B2 * | 4/2012 | DCosta | E21B 34/045 166/319 |
| 10,704,363 | B2 * | 7/2020 | Johnson | E21B 23/004 |
| 10,941,634 | B2 * | 3/2021 | Vick, Jr. | E21B 34/101 |

* cited by examiner

*Primary Examiner* — Matthew R Buck
(74) *Attorney, Agent, or Firm* — Eileen Pape

(57) ABSTRACT

A subsea valve system for use in a subsea landing string includes a subsea valve and an external manifold in fluid communication with the subsea valve. The external manifold includes a cylinder, a split manifold piston, an above bore inlet that is configured to be exposed to an above bore pressure, a below bore inlet that is configured to be exposed to a below bore pressure, and an open chamber outlet. The split manifold piston is configured to move within the cylinder to fluidly couple the above bore inlet to the open chamber outlet to enable pump through functionality while a respective force exerted on the manifold piston by the above bore pressure is greater than a respective force exerted on the manifold piston by the below bore pressure.

19 Claims, 9 Drawing Sheets

PUMP THROUGH FUNCTIONALITY IN SUBSEA VALVES USING EXTERNAL MANIFOLD

CROSS-REFERENCE TO RELATED APPLICATION

This application claims priority to and the benefit of U.S. Provisional Application No. 62/865,474, entitled "PUMP THROUGH FUNCTIONALITY IN SUBSEA VALVES USING EXTERNAL MANIFOLD," filed Jun. 24, 2019, which is hereby incorporated by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

In subsea operations, hydrocarbon fluids (e.g., oil and natural gas) are obtained from a subterranean geologic formation, referred to as a reservoir, by drilling a well that penetrates the subterranean geologic formation. In some subsea operations, a valve (e.g., ball valve) in a subsea landing string may incorporate pump through functionality, which enables an operator to kill the well in the event a control line pressure from an umbilical is lost and/or may be used to equalize pressure to prevent an underbalanced situation prior to opening the valve. Generally, this pump through functionality is incorporated in a valve piston that is located within a housing of the valve by referencing above and below bore pressures. A differential between the above and below bore pressures acts on the valve piston to overcome friction from valve seals and a valve operating mechanism; however, it is important to ensure that the differential is small to block damage to a seal (e.g., ball seal) of the valve.

SUMMARY

In an embodiment, a subsea system for use at a well includes a subsea valve system for use in a subsea landing string. The subsea valve system includes a subsea valve and an external manifold in fluid communication with the subsea valve. The external manifold includes a cylinder, a split manifold piston within the cylinder, an above bore inlet that is configured to be exposed to an above bore pressure, a below bore inlet that is configured to be exposed to a below bore pressure, and an open chamber outlet. The split manifold piston is configured to move within the cylinder to isolate the above bore inlet from the open chamber outlet to block pump through functionality while a respective force exerted on the split manifold piston by the above bore pressure is less than or equal to a respective force exerted on the split manifold piston by the below bore pressure and to fluidly couple the above bore inlet to the open chamber outlet to enable pump through functionality while the respective force exerted on the split manifold piston by the above bore pressure is greater than the respective force exerted on the split manifold piston by the below bore pressure In an embodiment, an external manifold is configured to provide pump through functionality for a subsea valve. The external manifold includes a cylinder, a manifold piston within the cylinder, an above bore inlet that is configured to be exposed to an above bore pressure in a first portion of a bore, wherein the first portion of the bore is located between the subsea valve and a platform at a sea surface, a below bore inlet that is configured to be exposed to a below bore pressure in a second portion of the bore, wherein the second portion of the bore is located between the subsea valve and a well, and an open chamber outlet. The manifold piston is configured to move within the cylinder to isolate the open chamber outlet while a respective force exerted on the manifold piston by the above bore pressure is less than or equal to a respective force exerted on the manifold piston by the below bore pressure and to enable a fluid flow to the open chamber outlet while the respective force exerted on the manifold piston by the above bore pressure is greater than the respective force exerted on the manifold piston by the below bore pressure.

In an embodiment, a subsea valve system for use in a subsea landing string includes a subsea valve having a housing and an adjustable valve element that is configured to function between an open position and a closed position. The subsea valve system also includes an external manifold positioned outside of the housing and in fluid communication with the subsea valve, wherein the external manifold is configured to provide pump through functionality for the subsea valve by fluidly coupling an above bore pressure to an open chamber of the subsea valve while an above bore pressure is greater than the below bore pressure.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
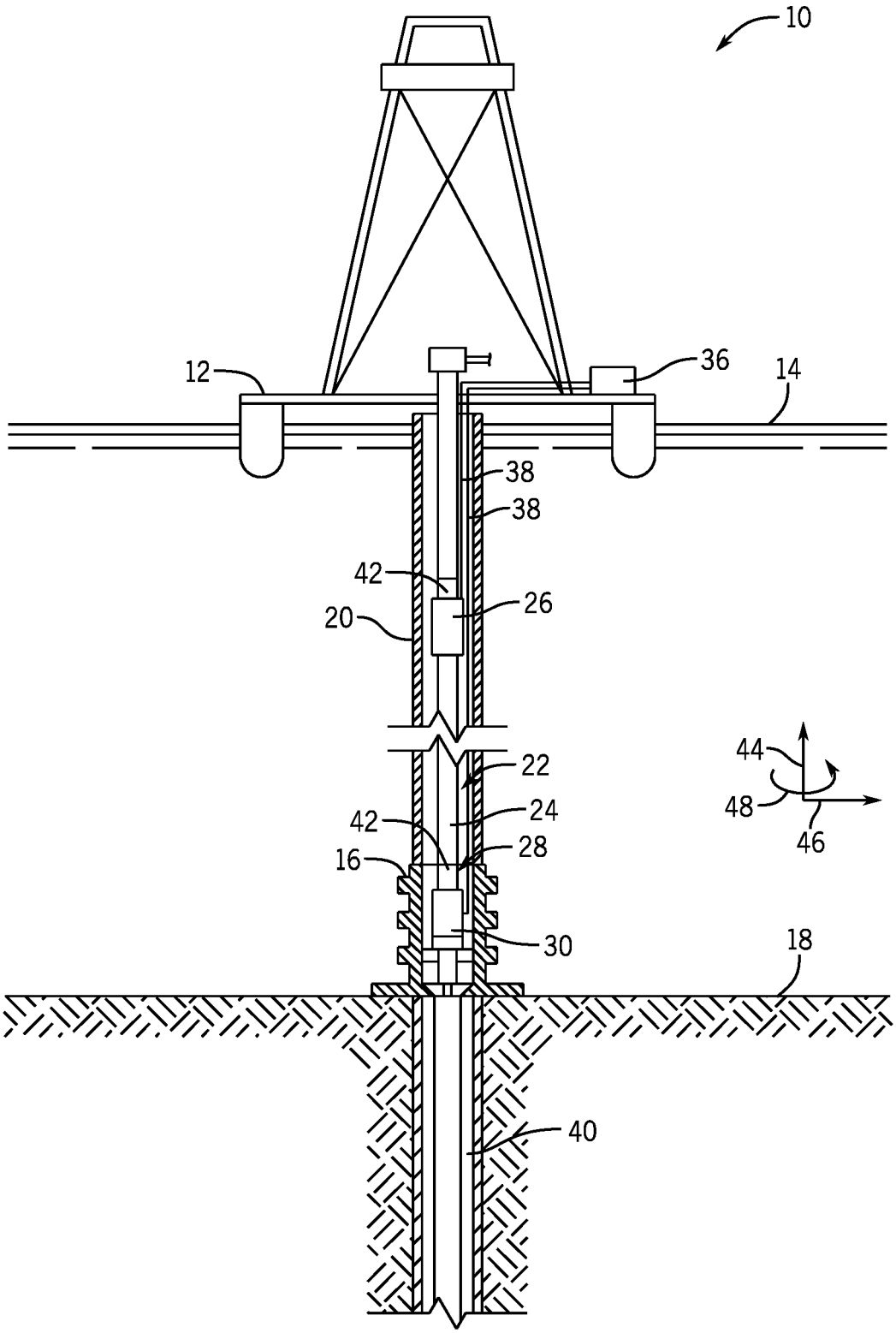
FIG. 1 is a schematic illustration of a subsea system that includes an external manifold that may be used to provide pump through functionality to a subsea valve, according to an embodiment of the present disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," "said," and the like, are intended to mean that there are one or more of the elements. The terms "comprising," "including," "having," and the like are intended to be inclusive and mean that there may be additional elements other than the listed elements. The use of "top," "bottom," "above," "below," and variations of these terms is made for convenience, but does not require any particular orientation of the components relative to some fixed reference, such as the direction of gravity. The term "fluid" encompasses liquids, gases, vapors, and combinations thereof. Numerical terms, such as "first," "second," and "third" are used to distinguish components to facilitate discussion, and it should be noted that the numerical terms may be used differently or assigned to different elements in the claims.

The disclosure herein generally involves an improved subsea valve system with pump through functionality. By way of example, the improved subsea valve system may include a subsea valve (e.g., lubricator valve) that is used along a subsea landing string. The improved subsea valve system may be used within subsea systems with working pressures above 100 Megapascal (MPa) (e.g., 15,000 pounds per square inch [psi]), such as in subsea systems with working pressures around 138 MPa (e.g., 20,000 psi).

More particularly, in some embodiments, the improved subsea valve system includes the subsea valve combined with an external manifold that is constructed to enable the pump through functionality. The external manifold is constructed such that the pump through functionality is realized and limited to conditions in which an above bore pressure (e.g., above the subsea valve relative to a well) is higher than a below bore pressure (e.g., below the subsea valve relative to the well). Advantageously, the pump through functionality may be achieved via the external manifold that is positioned outside of a valve housing that houses a valve element (e.g., ball) of the subsea valve and/or that is otherwise positioned to be physically separate from (e.g., not in contact with) a piston operator that adjusts the valve element. Thus, the pump through functionality may not rely on or be provided via additional structures (e.g., dedicated to pump through functionality) within the valve housing and/or physically attached to the piston operator. Without the external manifold, such additional structures may be used and may result in an increased length of the valve housing and/or may be particularly difficult to accommodate/package within a diameter (or width) of the valve housing for the subsea valve that operates with higher working pressures, e.g. pressures above 100 MPa (e.g., 15,000 psi). This is due to frictional forces that are considerably higher, and thus, a larger surface area of the additional structures (e.g., pump through piston) within the valve housing.

FIG. 1 is an embodiment of a subsea system 10. As shown, the subsea system 10 includes an offshore vessel or platform 12 at a sea surface 14. A stack assembly 16 (e.g., a blowout preventer [BOP] stack and/or a lower marine riser package [LMRP]) is positioned at or above a sea floor 18. A riser 20 (e.g., marine drilling riser) extends from the platform 12 to the stack assembly 16.

During certain operations (e.g., intervention operations), a landing string 22 (e.g., landing string assembly or system) may be deployed through the riser 20. The landing string 22 may include a landing string tubular 24 and a lubricator valve 26 that are positioned within the riser 20. The landing string 22 may also include a lower portion 28 that is positioned or landed within the stack assembly 16, and the lower portion 28 may include a subsea control valve 30 (e.g., ball valve).

The lubricator valve 26 and the subsea control valve 30 may each be independently, hydraulically controlled by a hydraulic control system to move between an open configuration and a closed configuration. More particularly, the lubricator valve 26 and the subsea control valve 30 may be independently, hydraulically controlled via a control fluid that is provided from a fluid source 36 at the platform 12 to the lubricator valve 26 and the subsea control valve 30 via umbilicals 38. For example, each of the lubricator valve 26 and the subsea control valve 30 may receive the control fluid via a respective pair of umbilicals 38: one that provides the control fluid to drive to the open configuration and one that provides the control fluid to drive to the closed configuration.

In operation, the landing string 22 may be used to flow fluids and/or convey tools between the platform 12 and a wellbore 40. Downhole operations (e.g., intervention operations) may be carried out by a conduit (e.g., coiled tubing, wireline) that extends from the platform 12, through the landing string tubular 24, through the lower portion 28 of the landing string 22, and into the wellbore 40. Thus, the lubricator valve 26 and the subsea control valve 30 may be generally maintained in the open configuration during the downhole operations (e.g., to enable the passage of the fluids and/or the tools between the platform 12 and the wellbore 40); however, the lubricator valve 26 and the subsea control valve 30 may also be controlled to move to the closed configuration (e.g., to block the passage of the fluids and/or the tools between the platform 12 and the wellbore 40) at certain times.

The lubricator valve 26 and/or the subsea control valve 30 may be configured to "fail-as-is," meaning that they remain in their actuated configuration (e.g., the open configuration or the closed configuration), or may be configured to "fail-closed," meaning that they adjust to the closed configuration, in an absence of the control fluid (e.g., upon failure of a hydraulic control system that delivers the control fluid from the fluid source 36 via the umbilicals 38). As discussed in more detail below, the lubricator valve 26 and/or the subsea control valve 30 may have pump through functionality provided via an external manifold 42 (e.g., one external manifold per valve). The pump through functionality may be initiated while the lubricator valve 26 and/or the subsea control valve 30 is in the closed configuration, and the pump through functionality may enable access to the wellbore 40. In particular, the pump through functionality may drive the lubricator valve 26 and/or the subsea control valve 30 from the closed configuration to the open configuration in the absence of the control fluid (e.g., during the failure of the hydraulic control system) to enable access to the wellbore 40. While the external manifold 42 is illustrated as being in-line with the landing string 22, it should be appreciated that the external manifold 42 may be positioned at any suitable location of the subsea system 10 that enables the external manifold 42 to provide the pump through functionality in the manner disclosed herein. To facilitate discussion, the landing string 22 and other components of the subsea system 10 may be described with reference to the vertical axis or direction 44, a radial axis or direction 46, and a circumferential axis or direction 48.

Figure 2:
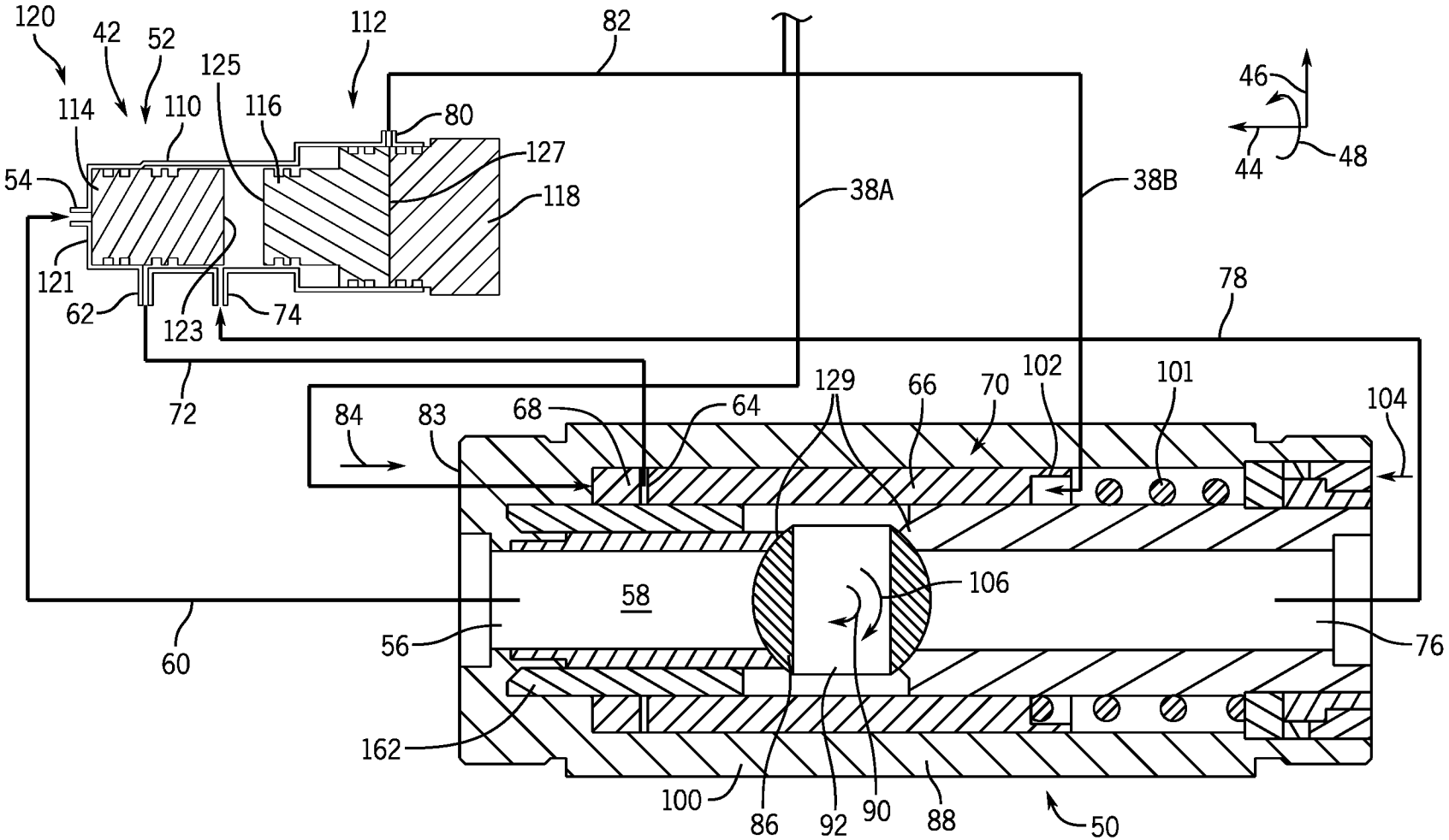
FIG. 2 is a cross-sectional side view of the external manifold of FIG. 1, wherein the external manifold is in a first configuration, according to an embodiment of the present disclosure.

FIG. 2 is a cross-sectional side view of an embodiment of the external manifold 42 and a subsea valve 50, which may be representative of either the lubricator valve 26 or the subsea control valve 30 of FIG. 1. That is, the external manifold 42 may be utilized with either the lubricator valve 26 of FIG. 1, the subsea control valve 30 of FIG. 1, or any other valve for which pump through functionality is desired.

As shown in FIG. 2, the external manifold 42 is in a first configuration 52 (e.g., default configuration). The external manifold 42 may include an above ball inlet 54 that is fluidly coupled to an above ball pressure within an above ball portion 56 of a bore 58 of the subsea valve 50 via a first line 60 (e.g., above ball line). The external manifold 42 may also include an open chamber outlet 62 that is fluidly coupled to an open chamber 64 (e.g., a pump through open chamber; secondary open chamber) defined between a first portion 66 and a second portion 68 of a split piston operator 70 (e.g., annular piston) via a second line 72 (e.g., open chamber line). The external manifold 42 may also include a below ball inlet 74 that is fluidly coupled to a below ball pressure within a below ball portion 76 of the bore 58 of the subsea valve 50 via a third line 78 (e.g., below ball line). The external manifold 42 may also include a close control inlet 80 that is fluidly coupled to a close control umbilical 82, which may connect to a fluid source (e.g., the fluid source 36 at the platform 12, as shown in FIG. 1).

During operation of the subsea valve 50 (e.g., without pump through functionality), the split piston operator 70 may be driven via delivery of the control fluid through an open umbilical line 38*a* or a close umbilical line 38*b*. More particularly, upon delivery of the control fluid through the open umbilical line 38*a* to a primary open chamber 83, the split piston operator 70 (e.g., both the first portion 66 and the second portion 68) may be driven in a first direction 84 away from the platform and toward the wellbore along the vertical axis 44. The split piston operator 70 is coupled (e.g., via a linkage member) to a ball 86 (e.g., rotatable or movable valve element) of the subsea valve 50, and the movement of the split piston operator 70 in the first direction 84 may drive the ball 86 to rotate in a first rotational direction 90 within its valve housing 88 to reach an open configuration in which a ball bore 92 of the ball 86 aligns with and is fluidly coupled to the bore 58 of the subsea valve 50 (e.g., coaxial). In the open configuration, the subsea valve 50 may enable the passage of fluid and/or tools across the subsea valve 50 (e.g., between the platform and the wellbore).

At certain times, such as during an unexpected increase in pressure in the below ball portion 76 of the bore 58 of the subsea valve 50 or at another location near or within the wellbore, the subsea valve 50 may be driven to a closed configuration 100 in which the ball bore 92 of the ball 86 does not align with and is not fluidly coupled to (e.g., is sealed from) the bore 58 of the subsea valve 50 (e.g., perpendicular). In the closed configuration 100, the subsea valve 50 may block the passage of fluid and/or tools across the subsea valve 50 (e.g., between the platform and the wellbore). The subsea valve 50 may be driven to the closed configuration 100 via a biasing member 101 and/or via delivery of the control fluid through the close umbilical line 38*b*. More particularly, upon delivery of the control fluid through the close umbilical line 38*b* to a close chamber 102 and/or in the absence of the control fluid at the primary open chamber 83, the split piston operator 70 may be driven in a second direction 104 away from the wellbore and toward the platform along the vertical axis 44. As shown, the second direction 104 is opposite the first direction 84. The movement of the split piston operator 70 in the second direction 104 may drive the ball 86 (e.g., via the linkage member) to rotate in a second rotational direction 106 within its valve housing 88 to reach the closed configuration 100. The second rotational direction 106 is opposite the first rotational direction 90. It should be appreciated that the movement of the split piston operator 70 in the first direction 84 may drive the ball 86 to rotate in the second rotational direction 106, and the movement of the split piston operator 70 in the second direction 104 may drive the ball 86 to rotate in the first rotational direction 90.

As noted above, it may be desirable to provide pump through functionality, which provides an alternative or additional way to drive the subsea valve 50 to the open configuration (e.g., in the event of loss of fluid pressure within the open umbilical line 38*a* or due to some other failure of the hydraulic control system). While the external manifold 42 is not positioned within the valve housing 88 and/or does not physically contact the split piston operator 70, the external manifold 42 is fluidly linked to the subsea valve 50 and to the split piston operator 70 to provide the pump through functionality. In addition to various fluid inlets and outlets described above, the external manifold 42 includes a cylinder 110 that houses a split manifold piston 112 (e.g., poppet). The split manifold piston 112 includes a first portion 114 and a second portion 116. The split manifold piston 112 may also include a third portion 118. Surfaces (e.g., drive surfaces) of the split manifold piston 112 may have the same surface areas or different surface areas (e.g., two surface areas; diameters). For example, a first surface 121 of the first portion 114 that is configured to be in contact with (e.g., acted upon by) the above bore pressure may have a first surface area, a second surface 123 of the first portion 114 that is configured to be in contact with (e.g., acted upon by) the below bore pressure may have a second surface area, and a third surface 125 of the second portion 116 that is configured to be in contact with (e.g., acted upon by) the below bore pressure may have a third surface area, and a fourth surface 127 of the second portion 116 that is configured to be in contact with (e.g., acted upon by) the control line pressure may have a fourth surface area. In some embodiments, including the illustrated embodiment, respective surface areas of the first, second, and third surfaces 121, 123, 125 are the same (e.g., equal or substantially equal) to one another, while the respective surface area of the fourth surface 127 is greater than that the respective surface areas of the first, second, and third surfaces 121, 123, 125.

During regular operations (e.g., not pump through operations) of the subsea valve 50, the external manifold 42 may generally remain in the first configuration 52. In the first configuration 52, the first portion 114 of the split manifold piston 112 is in a first position 120 within the cylinder 110 so as to isolate (e.g., seal; block) the above ball inlet 54 and the open chamber outlet 62 from one another. The respective surface areas 121, 123, 125, 127 of the split manifold piston 112 may be selected such that the split manifold piston 112 will stay in the first position 120 while the above ball pressure in the above ball portion 56 of the bore 58 is equal to and/or lower than the below ball pressure in the above ball portion 56 of the bore 58. Furthermore, the respective surface areas 121, 123, 125, 127 of the split manifold piston 112 may be designed such that a maximum positive differential pressure does not exceed a predetermined value, such as about 6 MPa (e.g., 1000 psi), over the entire range. This ensures that the ball 86 of the subsea valve 50 is not operated with high differential pressure across the ball 86, which limits the potential for damage to the ball 86 or a seat 129 for the ball 86.

As discussed in more detail below, it should be appreciated that the split manifold piston 112 may also be driven to and remain in the first position 120 while the control fluid applied via the close control inlet 80 is at a sufficient pressure (e.g., to apply a respective force greater than respective forces applied by the above bore pressure and the below bore pressure to thereby drive the second portion 116 of the split manifold piston 112 against the first portion 114 of the split manifold piston 112, to thereby drive the first portion 114 of the split manifold piston 112 to the first position 120). However, in some embodiments, the control fluid may be applied via the close control inlet 80, only in limited circumstances, such as when pressure testing is conducted from above. The close control umbilical 82 may split from the close umbilical line 38*b* (e.g., the control fluid may be provided to the close chamber 102 and to the close control inlet 80 at the same time). Generally, for regular opening operation of the subsea valve 50, the control fluid for closing may be vented from the external manifold 42, as illustrated in FIG. 2.

Figure 3:
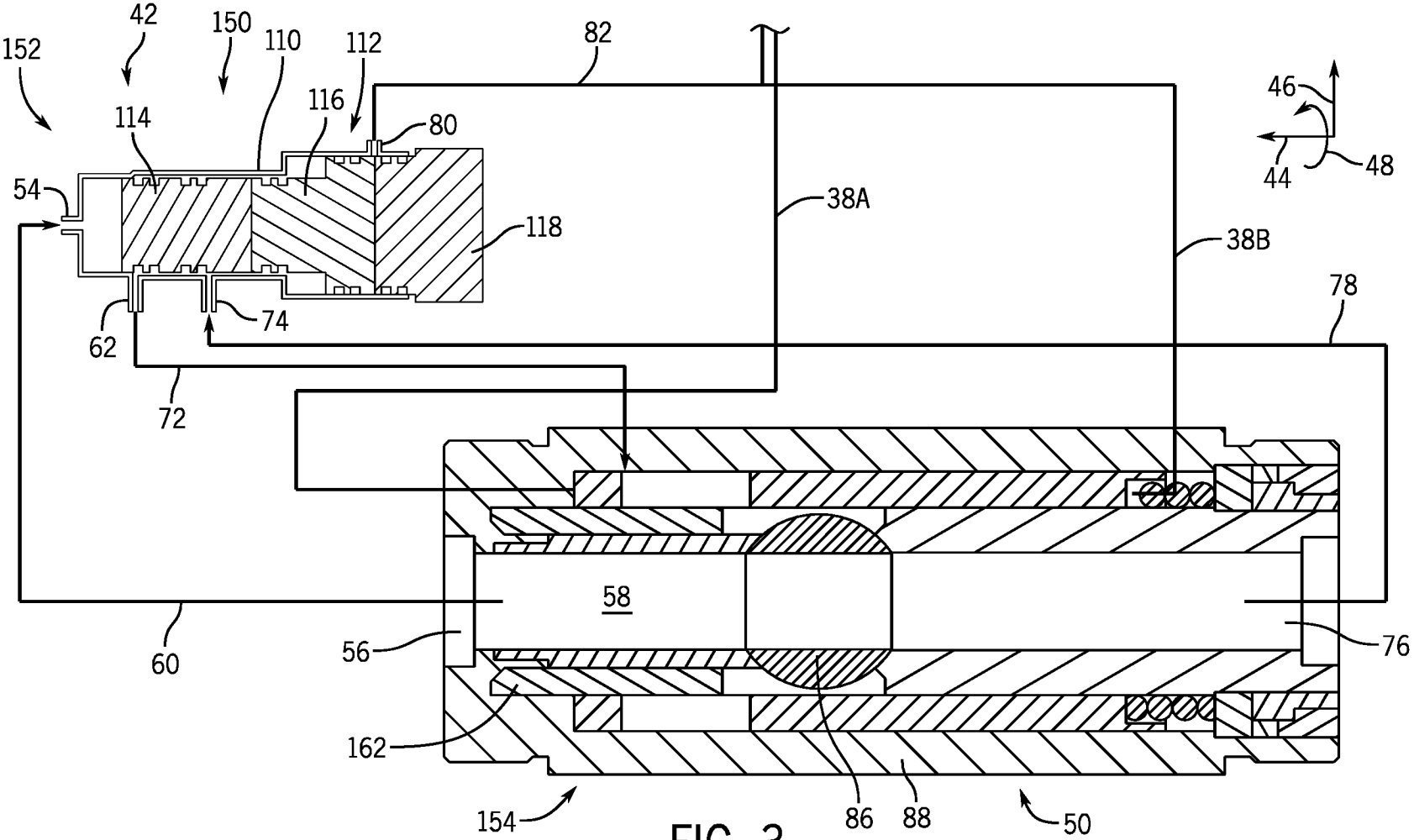
FIG. 3 is a cross-sectional side view of the external manifold of FIG. 2, wherein the external manifold is in a second configuration, according to an embodiment of the present disclosure.

FIG. 3 is a cross-sectional side view of the external manifold 42 and the subsea valve 50, wherein the external manifold 42 is in a second configuration 150 (e.g., pump through configuration). In the second configuration 150, the first portion 114 of the split manifold piston 112 is in a second position 152 within the cylinder 110 so as to fluidly couple the above ball inlet 54 and the open chamber outlet 62. In this way, the external manifold 42 may enable the above bore pressure to pass to the open chamber 64 defined between the first portion 66 and the second portion 68 of the split piston operator 70 via the second line 72. The first portion 114 of the split manifold piston 112 may be held in the second position 152 while (e.g., as long as) the above bore pressure is greater than the below bore pressure (and in the absence of the control fluid through the close control inlet 80/while the control fluid is vented). Generally, during the pump through operations, the control fluid may be vented from the external manifold 42, as illustrated in FIG. 3. When the above bore pressure reaches the open chamber 64, the above bore pressure may drive the second portion 68 of the split piston operator 70 in the first direction 84 relative to the valve housing 88, which drives the ball 86 to rotate to assume an open configuration 154.

Thus, as shown, the external manifold 42 is in fluid communication with the subsea valve 50 and is able to adjust the ball 86 in a manner that provides pump through functionality for the subsea valve 50. The external manifold 42 and the subsea valve 50 may be particularly useful in cases in which the control line pressure (e.g., via the close control umbilical 82 and/or the umbilicals 38), the above bore pressure, and/or the below bore pressure is relatively high, such as over 100 MPa and/or around 138 MPa. Advantageously, in the disclosed embodiments, the pump through functionality may be provided without increasing surface areas of structures (e.g., additional structures designated for pump through functionality; piston operator) within the valve housing 88 of the subsea valve 50, which may facilitate positioning the subsea valve 50 through the riser, for example. Furthermore, without such additional structures, a length and/or a width of the valve housing 88 for the subsea valve 50 (and thus, an overall length and/or width of the subsea valve 50) may be reduced as compared to some existing subsea valves that may include such additional structures to effectuate pump through functionality. The external manifold 42 and the subsea valve 50 may form a pump through system that provides friction characteristics that are independent of other operations (e.g., area bias for failsafe close function) of the subsea valve 50, thus providing a more reliable subsea valve 50. Furthermore, the external manifold 42 may be tested independently, which makes it easier to test pump through functionality.

Figure 4:
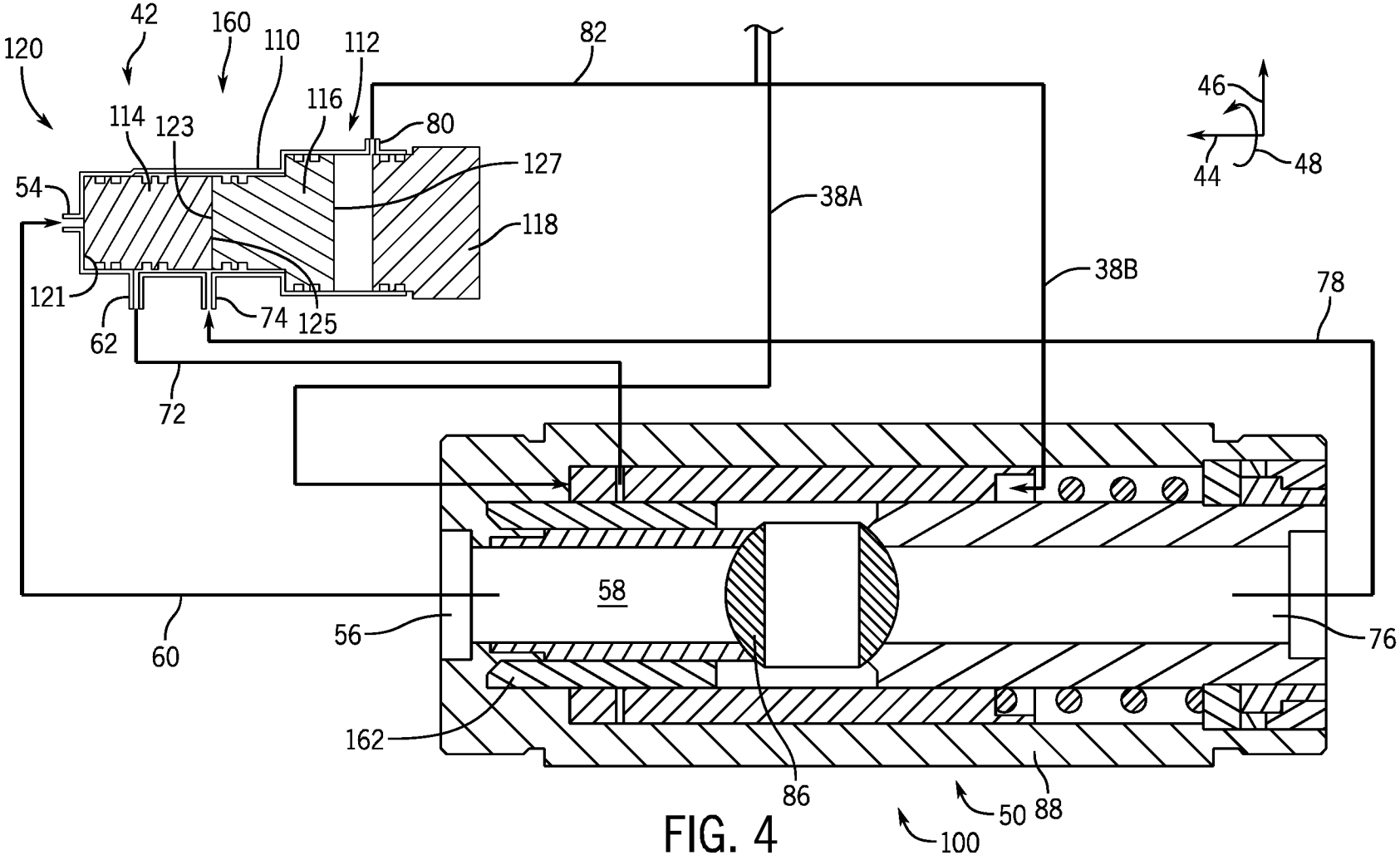
FIG. 4 is a cross-sectional side view of the external manifold of FIGS. 2 and 3, wherein the external manifold is in a third configuration, according to an embodiment of the present disclosure.

FIG. 4 is a cross-sectional side view of an embodiment of the external manifold 42 and the subsea valve 50, wherein the external manifold 42 is in a third configuration 160 (e.g., test configuration). In the third configuration 160, the first portion 114 of the split manifold piston 112 is in the first position 120 within the cylinder 110 so as to isolate the above ball inlet 54 from the open chamber outlet 62. In this way, the external manifold 42 may block the above bore pressure from reaching the open chamber 64 defined between the first portion 66 and the second portion 68 of the split piston operator 70 via the second line 72; therefore, allowing to test the subsea landing string above the ball 86 without pumping through.

In some embodiments, the control fluid may be provided via the close control umbilical 82 to drive the second portion 116 against the first portion 114 and to hold the external manifold 42 in the third configuration 160. The fourth surface 127 having a greater respective surface area as compared to the first, second, and third surfaces 121, 123, 125 may facilitate (e.g., via generation of greater force for a given pressure) driving the second portion 116 against the first portion 114 for this purpose. The first portion 114 of the split manifold piston 112 may be held in the first position 120 while the control fluid applied via the close control inlet 80 is at a sufficient pressure (e.g., to apply a respective force greater than respective forces applied by the above bore pressure and the below bore pressure to thereby drive the second portion 116 of the split manifold piston 112 against first portion 114 of the split manifold piston 112). The control fluid may be applied via the close control inlet 80 when pressure testing is conducted from above and when the subsea valve 50 needs to be closed.

It should be appreciated that the external manifold 42 may be used for pump through functionality only when the umbilicals and the landing string are intact and/or are not sheared. As shown in FIGS. 2-4, it may be desirable to also include a pump through piston 162 (e.g., a typical or conventional pump through piston) within the valve housing 88, such as between the seat 129 located in the above ball portion 56 of the bore 58 and the split piston operator 70 along the radial axis 46. When the umbilicals and the landing string are sheared, the above ball pressure may act on the pump through piston 162 to drive the pump through piston 162, and the split piston operator 70 coupled thereto in the first direction 84. In this way, the movement of the pump through piston 162 may drive the ball 86 to rotate to reach the open configuration 154.

Figure 6:
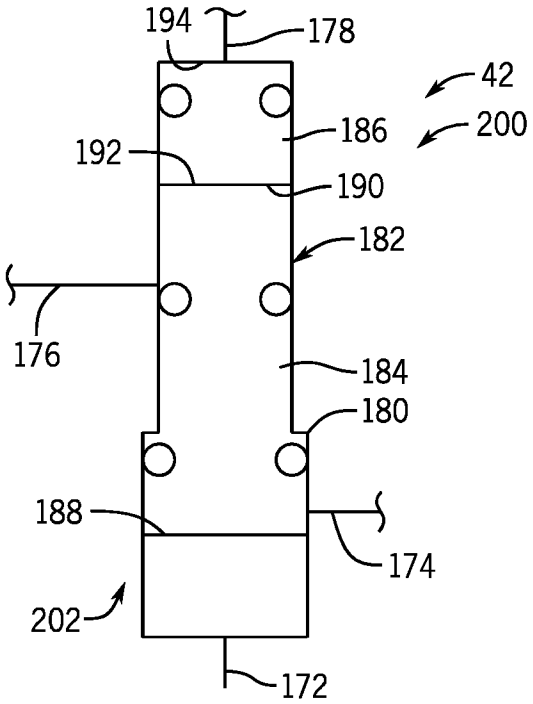
FIG. 6 is a cross-sectional side view of the external manifold of FIG. 5, wherein the external manifold is in a second configuration, according to an embodiment of the present disclosure.
Figure 5:
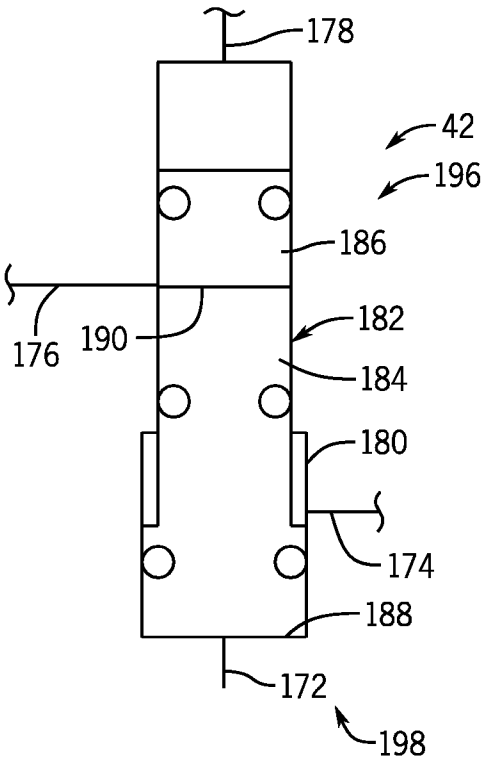
FIG. 5 is a cross-sectional side view of the external manifold of FIG. 1, wherein the external manifold includes a two-part piston and is in a first configuration, according to an embodiment of the present disclosure.

FIGS. 5 and 6 are cross-sectional side views of an embodiment of the external manifold 42, wherein the external manifold 42 includes a two-part piston 170. The external manifold 42 of FIGS. 5 and 6 may operate similarly to the external manifold 42 of FIGS. 2-4, and is shown here to provide thorough discussion and to further illustrate that the techniques may be accomplished via various configurations of the external manifold 42 and are not intended to be limited to a single structure or configuration of the external manifold 42. As shown, the external manifold 42 may include an above ball inlet 172 that is fluidly coupled to an above ball pressure within an above ball portion of a bore of the subsea valve via a first line (e.g., above ball line). The external manifold 42 may also include an open chamber outlet 174 that is fluidly coupled to an open chamber (e.g., a pump through open chamber; secondary open chamber) defined between a first portion and a second portion of a split piston operator (e.g., annular piston) via a second line (e.g., open chamber line). The external manifold 42 may also include a below ball inlet 176 that is fluidly coupled to a below ball pressure within a below ball portion of the bore of the subsea valve via a third line (e.g., below ball line). The external manifold 42 may also include a close control inlet 178 that is fluidly coupled to a close control umbilical, which may connect to a fluid source (e.g., the fluid source 36 at the platform 12, as shown in FIG. 1).

In addition to various fluid inlets and outlets described above, the external manifold 42 includes a cylinder 180 that houses a split manifold piston 182. The split manifold piston 182 includes a first portion 184 and a second portion 186. The split manifold piston 182 may have the same or multiple different surface areas (e.g., two surface areas; diameters). For example, a first surface 188 of the first portion 184 that is configured to be in contact with (e.g., acted upon by) the above bore pressure may have a first surface area, a second surface 190 of the first portion 184 that is configured to be in contact with (e.g., acted upon by) the below bore pressure may have a second surface area, and a third surface 192 of the second portion 186 that is configured to be in contact with (e.g., acted upon by) the below bore pressure may have a third surface area, and a fourth surface 194 of the second portion 186 that is configured to be in contact with (e.g., acted upon by) the control line pressure may have a fourth surface area. In some embodiments, including the illustrated embodiment, respective surface areas of the second, third, and fourth surfaces 190, 192, 194 are the same (e.g., equal or substantially equal) to one another, while the respective surface area of the first surface 188 is greater than that the respective surface areas of the second, third, and fourth surfaces 190, 192, 194. Thus, the above bore pressure may act upon the first surface 188 with the greater surface area to thereby drive the split manifold piston 182 to facilitate the pump through functionality.

In particular, FIG. 5 illustrates the external manifold 42 in a third configuration 196 (e.g., test configuration) in which the control fluid is provided via the close control inlet 178 and drives the split manifold piston 182 into a first position 198 in which the first portion 184 of the split manifold piston 182 isolates (e.g., seals; blocks) the above ball inlet 172 and the open chamber outlet 174 from one another. As noted above, the control fluid may be provided in certain circumstances, such as during testing procedures. In the absence of the control fluid (e.g., shut off; vented), the first portion 184 of the split manifold piston 182 may be adjusted based on a differential between the above bore pressure and the below bore pressure. In particular, the first portion 184 of the split manifold piston 182 may remain in the first position 198 to isolate the above ball inlet 172 from the open chamber outlet 174 while a respective force applied to the first portion 184 of the split manifold piston 182 by the above bore pressure is less than a respective force applied to the first portion 184 of the split manifold piston 182 by the below bore pressure (and in the absence of the control fluid through the close control inlet 178/while the control fluid is vented), and this may be referred to herein as a first configuration (e.g., default configuration) of the external manifold 42.

Furthermore, as shown in FIG. 6, the external manifold 42 may move to a second configuration 200 (e.g., pump through configuration) in which the first portion 184 of the split manifold piston 182 is in a second position 202 within the cylinder 180 so as to fluidly couple the above ball inlet 172 and the open chamber outlet 174 to one another. In particular, the first portion 184 of the split manifold piston 182 may remain in the second position 202 to fluidly couple the above ball inlet 172 to the open chamber outlet 174 while the respective force applied to the first portion 184 of the split manifold piston 182 by the above bore pressure is greater than the respective force applied to the first portion 184 of the split manifold piston 182 by the below bore pressure (and in the absence of the control fluid through the close control inlet 178/while the control fluid is vented). It should be appreciated that the pressure differential that results in the movement of the first portion 184 of the split manifold piston 182 may vary based on a difference between the first surface area of the first surface 188 and the second surface area of the second surface 190. When the above bore pressure reaches the open chamber of the subsea valve, the above bore pressure may drive the second portion of the split piston operator in the first direction within the valve housing, which drives the ball to rotate to assume an open configuration.

Figure 7:
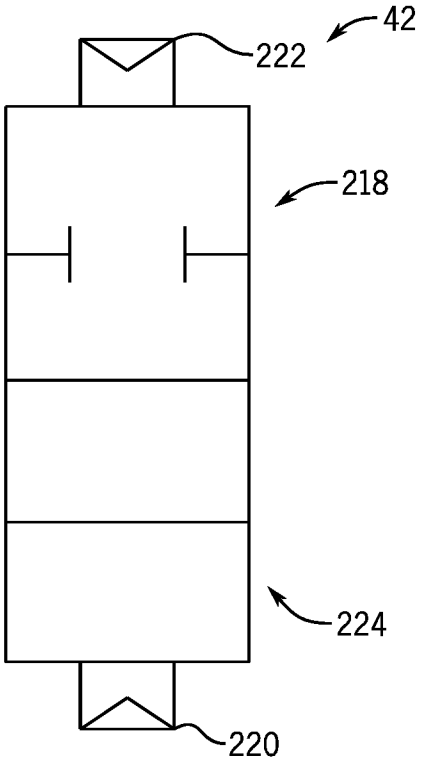
FIG. 7 is a schematic illustration of the external manifold of FIG. 1, wherein the external manifold is configured to couple an above bore pressure to an open chamber to provide the pump through functionality to the subsea valve, according to an embodiment of the present disclosure.

FIG. 7 is a schematic illustration of the external manifold 42 that operates in the manner described above with respect to FIGS. 2-6. FIG. 7 is also shown to provide thorough discussion and to further illustrate that the techniques may be accomplished via various configurations of the external manifold 42 and are not intended to be limited to a single structure or configuration of the external manifold 42. In particular, as represented in box 218, when a respective force due to an above bore pressure applied via an above bore pressure inlet 220 is less than a respective force due to a below bore pressure applied via a below bore pressure inlet 222, the external manifold 42 is configured to isolate the above bore pressure inlet 220 from an open chamber outlet. Furthermore, when the respective force due to the above bore pressure applied via the above bore pressure inlet 220 is greater than a respective force due to the below bore pressure applied via the below bore pressure inlet 222, the external manifold 42 is configured to couple the above bore pressure inlet to the open chamber outlet. In this way, the external manifold 42 may provide the pump through functionality when the above bore pressure is greater than the below bore pressure. As noted above, the external manifold 42 may include different configuration and dimensions (e.g., surface areas), which may affect the pressure differential (e.g., between the above bore pressure and the below bore pressure) that enables or blocks the pump through functionality. It should be appreciated that a biasing member, such as a spring, may be used instead of or in addition to the different dimension to affect the pressure differential that enables or blocks the pump through functionality.

Figure 8:
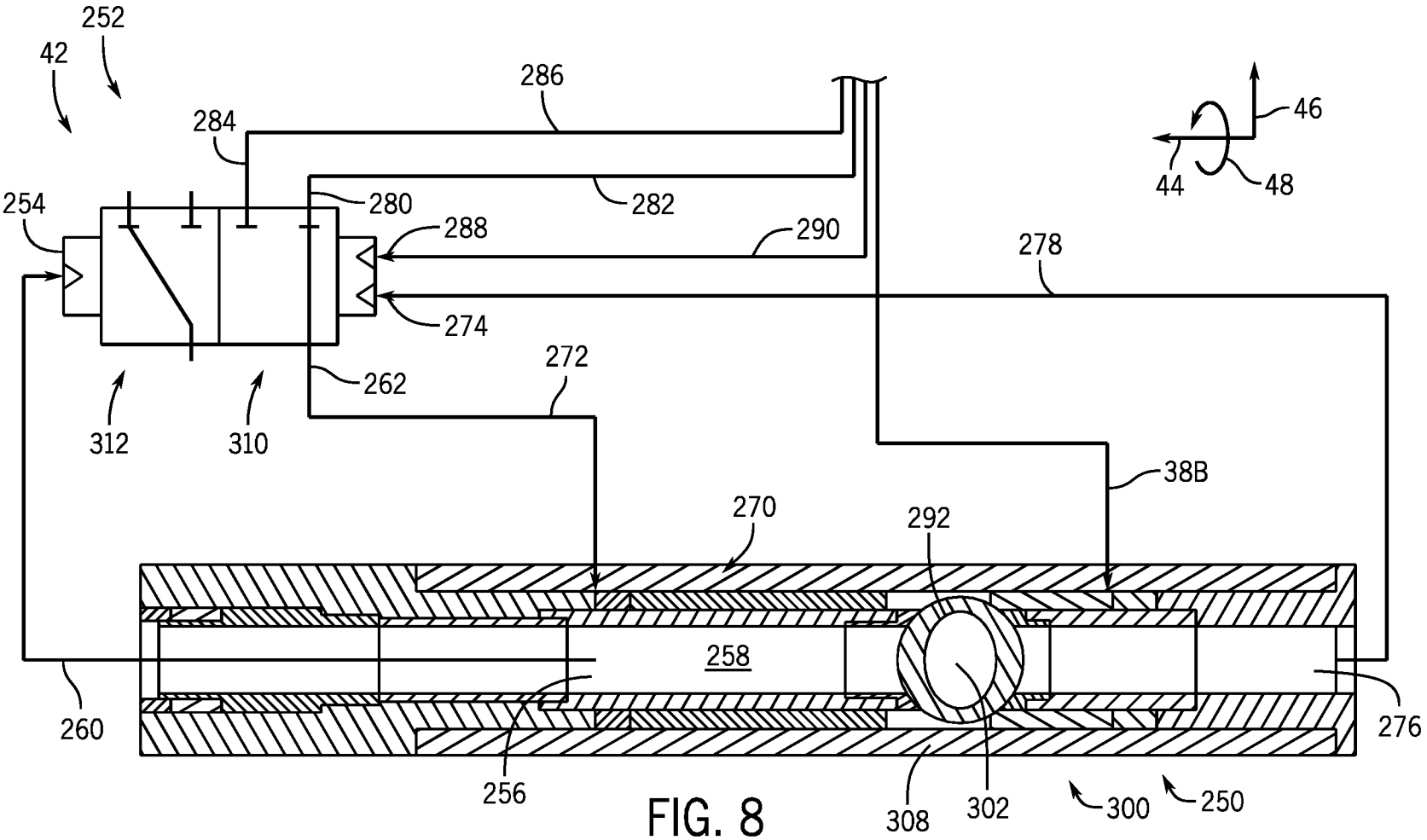
FIG. 8 is a schematic illustration of the external manifold of FIG. 1, wherein multiple umbilicals extend to the external manifold and the external manifold is in a first configuration, according to an embodiment of the present disclosure.
Figure 9:
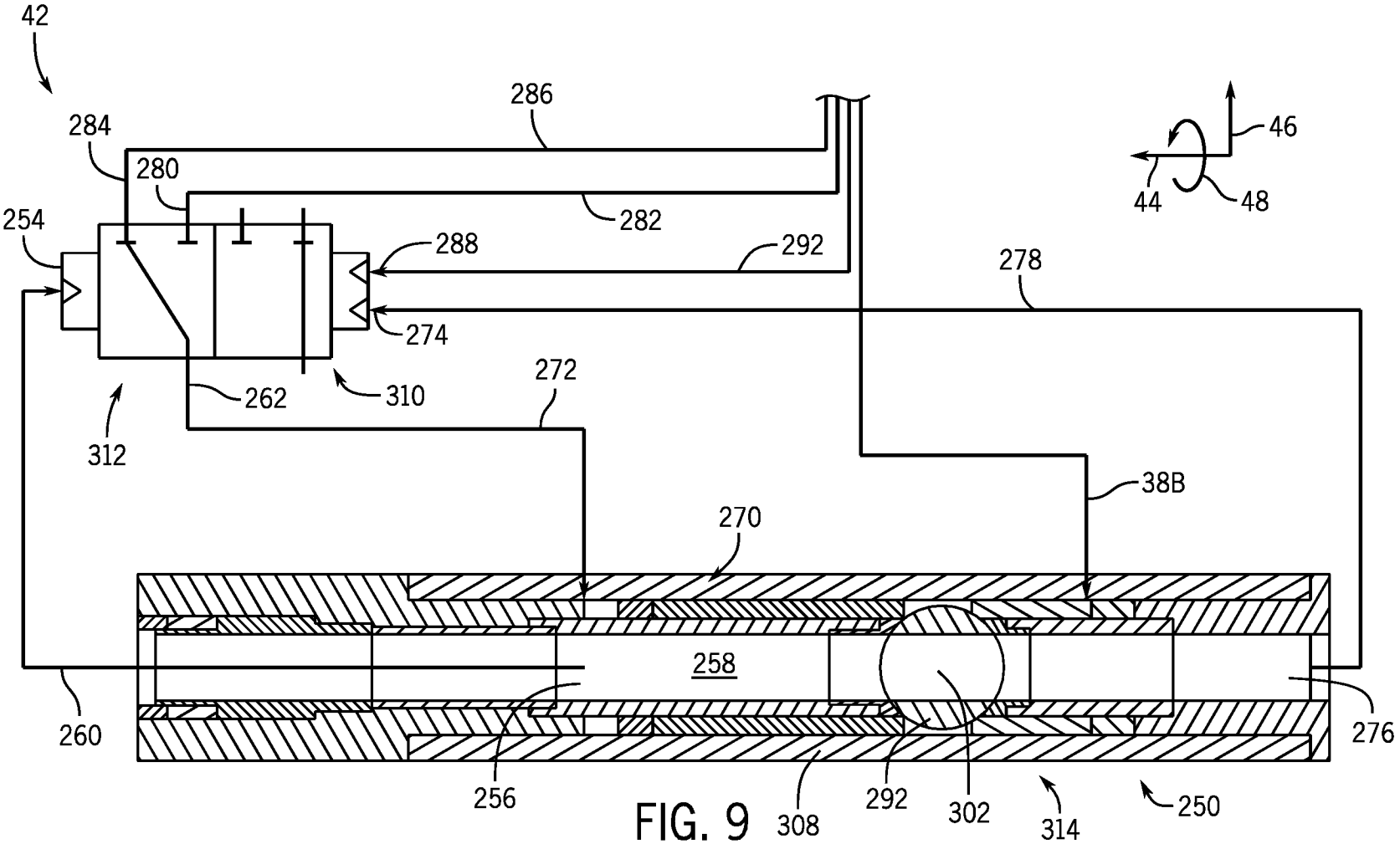
FIG. 9 is a schematic illustration of the external manifold of FIG. 8, wherein the external manifold is in a second configuration, according to an embodiment of the present disclosure.

FIGS. 8 and 9 include schematic illustrations of an embodiment of the external manifold 42 and cross-sectional side views of a subsea valve 250. The subsea valve 250 may be representative of the lubricator valve 26 of FIG. 1, the subsea control valve 30 of FIG. 1, or any other valve; however, the external manifold 42 of FIGS. 8 and 9 may be particularly useful for the lubricator valve 26 of FIG. 1.

As shown in FIG. 8, the external manifold 42 is in a first configuration 252 (e.g., default configuration). The external manifold 42 may include an above ball inlet 254 that is fluidly coupled to an above ball pressure within an above ball portion 256 of a bore 258 of the subsea valve 250 via a first line 260 (e.g., above ball line). The external manifold 42 may also include an open chamber outlet 262 that is fluidly coupled to an open chamber 264 (e.g., a pump through open chamber; secondary open chamber) defined at one end of a piston operator 270 (e.g., annular piston) via a second line 272 (e.g., open chamber line). The external manifold 42 may also include a below ball inlet 274 that is fluidly coupled to a below ball pressure within a below ball portion 276 of the bore 258 of the subsea valve 250 via a third line 278 (e.g., below ball line). The external manifold 42 may also include an open inlet 280 that is fluidly coupled to an open control umbilical 282, which may connect to a fluid source (e.g., the fluid source 36 at the platform 12, as shown in FIG. 1). Furthermore, the external manifold 42 may include a pump through inlet 284 that is fluidly coupled to a pump through umbilical line 286 and/or a pilot line inlet 288 that is fluidly coupled to a pilot umbilical line 290, wherein the pump through umbilical line 286 and/or the pilot umbilical line 290 may connect to a fluid source (e.g., the fluid source 36 at the platform 12, as shown in FIG. 1). In some embodiments, the pilot line inlet 288 may be supplemented or replaced by a biasing member, such as a spring, that biases the external manifold 42 toward the first configuration 252.

During operation of the subsea valve 250 (e.g., without pump through functionality), the piston operator 270 (and the ball 292 coupled thereto, within a valve housing 308) may be driven via delivery of the control fluid through the second line 272 (e.g., via the open inlet 280 to the open chamber outlet 262 across the external manifold 42) or a close umbilical line **38*b*. Generally, as represented by box 310, the piston operator 270 may be driven via delivery of the control fluid through the second line 272 so that the ball 292 is maintained in an open configuration when a respective force due to an above bore pressure applied via the above ball inlet 254 is less than a respective force due to a below bore pressure applied via the below ball inlet 274 and/or the respective force due to a pilot line pressure applied via the pilot line inlet 288. However, at certain times, such as during an unexpected increase in pressure in the below ball portion 276 of the bore 258 of the subsea valve 250 or at another location near or within the wellbore, the subsea valve 250 may be driven via delivery of the control fluid through the close umbilical line 38*b* to a closed configuration 300 in which a ball bore 302 of the ball 292 does not align with and is not fluidly coupled to (e.g., is sealed from) the bore 258 of the subsea valve 250** (e.g., perpendicular).

As noted above, it may be desirable to provide pump through functionality, which provides an alternative or additional way to drive the subsea valve 250 to the open configuration while ensuring that the well is overbalanced (e.g., the above ball pressure is higher than the below ball pressure). As best shown in FIG. 9 and represented in box 312, when the respective force due to the above bore pressure applied via the above ball inlet 254 is greater than the respective force due to the below bore pressure applied via the below ball inlet 274 and/or the respective force due to the pilot line pressure applied via the pilot line inlet 288, the external manifold 42 couples the pump through inlet 284 to the open chamber outlet 262. In this way, the external manifold 42 may provide the control fluid to enable pump through functionality and drive the subsea valve 250 to an open configuration 314 when the above bore pressure is greater than the below bore pressure. For example, the pump through inlet 284 may only be coupled to the open chamber outlet 262 while the respective force due to the above bore pressure applied via the above ball inlet 254 is greater than the respective force due to the below bore pressure applied via the below ball inlet 274 and the respective force due to the pilot line pressure applied via the pilot line inlet 288. In some cases, the pilot line pressure may be adjusted (e.g., increased or decreased) while the subsea valve 250 is in the closed configuration 300 to adjust the above bore pressure that is sufficient to enable the pump through functionality (e.g., to connect the pump through inlet 284 to the open chamber outlet 262). For example, the pilot line pressure may be reduced to zero (e.g., zero or near zero), and thus, the pump through functionality may be enabled in response to a difference between the respective forces applied by the above bore pressure and the below bore pressure.

It should be appreciated that the external manifold 42 may include a cylinder and piston (e.g., split manifold piston; poppet) assembly, and movement of the piston within the cylinder is represented via the schematic illustration of the external manifold 42. Furthermore, as discussed above, the piston may include various configurations and dimensions (e.g., the same or different surface areas), which may affect the pressure differential (e.g., between the above bore pressure and the below bore pressure) that enables or blocks the pump through functionality.

It should be appreciated that the external manifold 42 may be used for pump through functionality only when the umbilicals and the landing string are intact and are not sheared. In some embodiments, it may be desirable to also include features within the valve housing 308 that enable pump through functionality (e.g., in a typical or conventional manner) when the umbilicals and the landing string are sheared. For example, the external manifold 42 may be used in addition to (e.g., at different time) slickline activation techniques.

Figure 10:
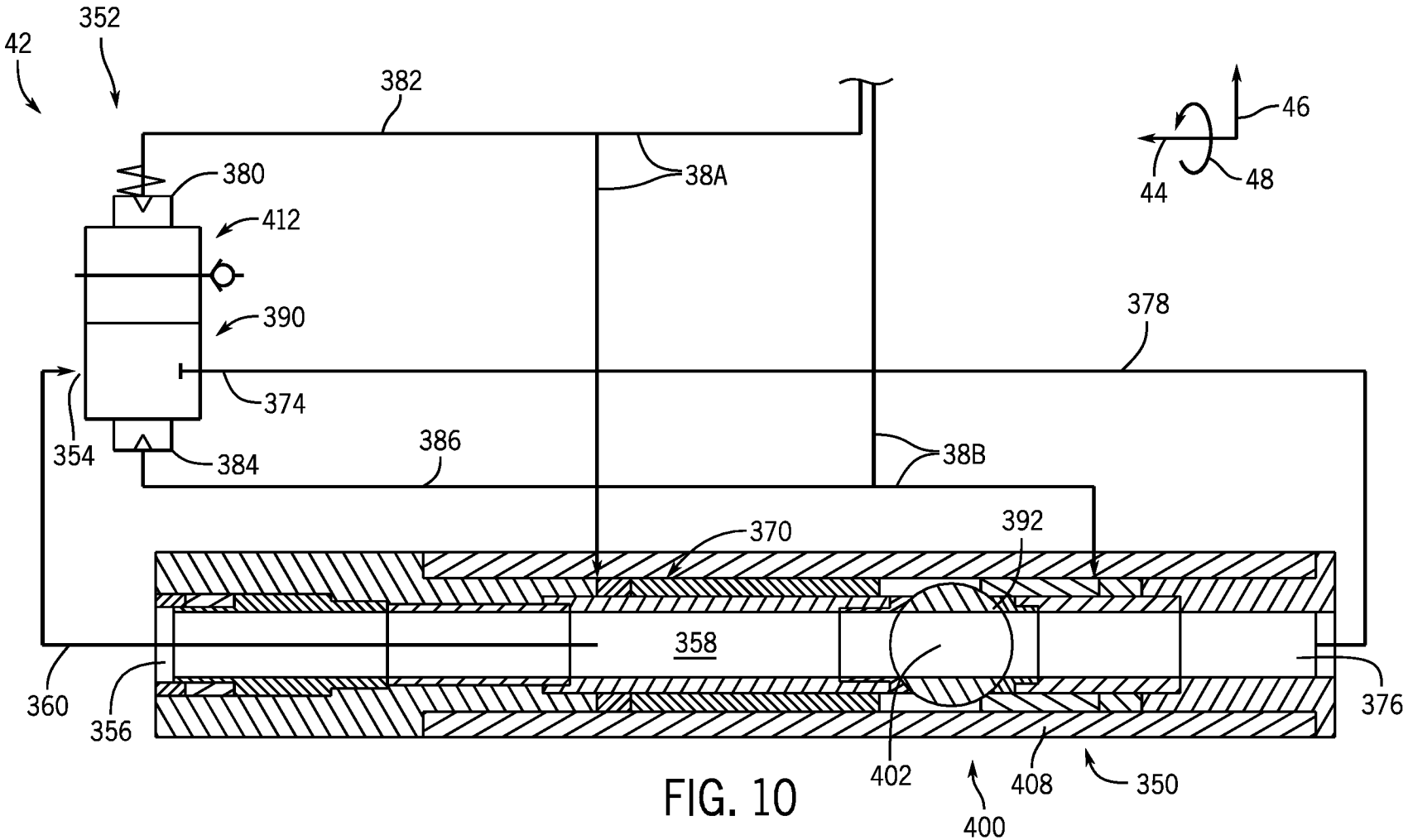
FIG. 10 is a schematic illustration of the external manifold of FIG. 1, wherein the external manifold is configured to balance equalize an above bore pressure and a below bore pressure and the external manifold is in a first configuration, according to an embodiment of the present disclosure.
Figure 11:
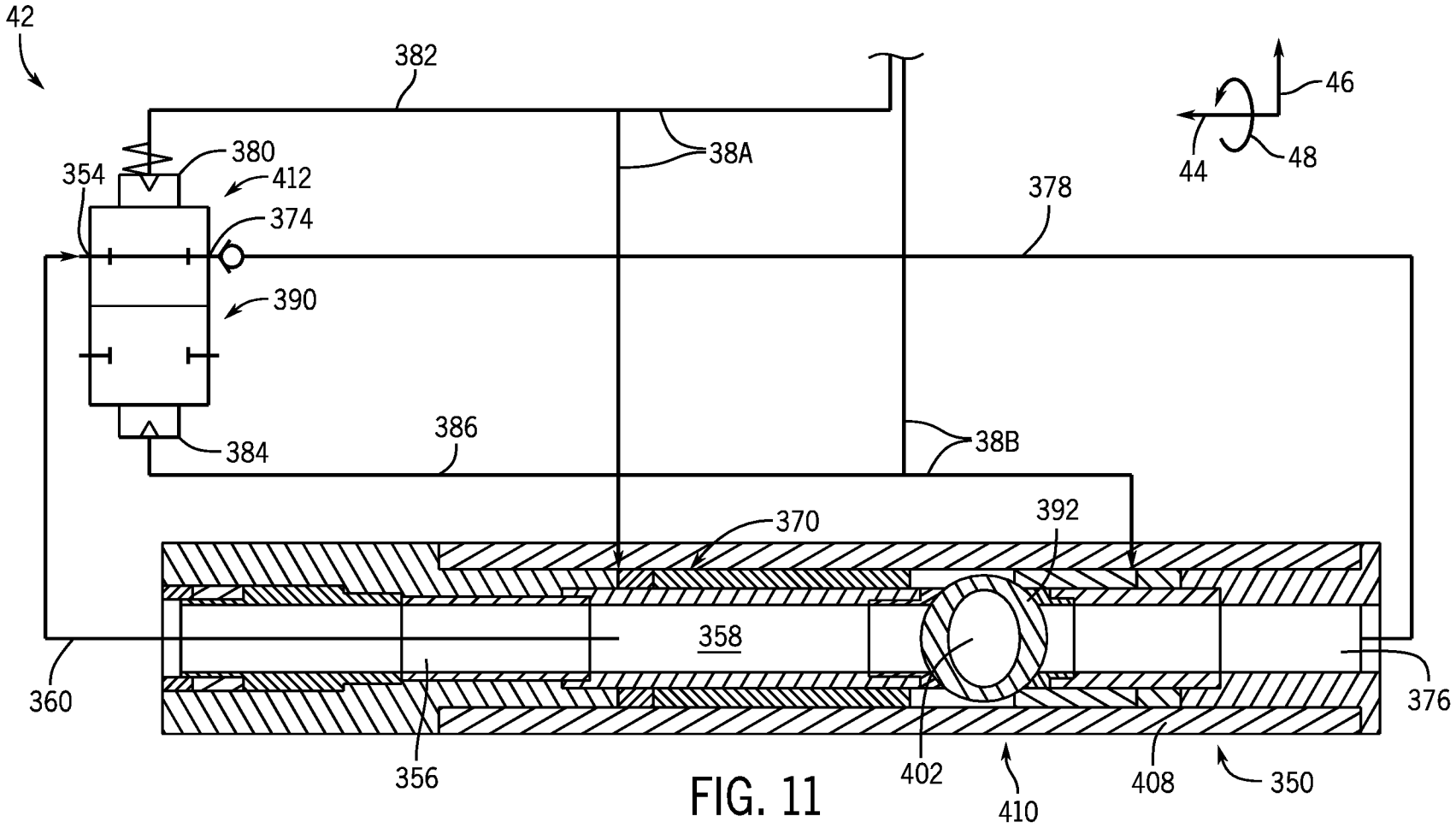
FIG. 11 is a schematic illustration of the external manifold of FIG. 10, wherein the external manifold is in a second configuration, according to an embodiment of the present disclosure.

FIGS. 10 and 11 include schematic illustrations of an embodiment of the external manifold 42 and cross-sectional side views of a subsea valve 350. The subsea valve 350 may be representative of the lubricator valve 26 of FIG. 1, the subsea control valve 30 of FIG. 1, or any other valve; however, the external manifold 42 of FIGS. 10 and 11 may be particularly useful for the lubricator valve 26 of FIG. 1.

As shown in FIGS. 10 and 11, the external manifold 42 is an equalizing or balancing poppet. In FIG. 10, the external manifold 42 is in a first configuration 352 (e.g., default configuration). The external manifold 42 may include an above ball inlet 354 that is fluidly coupled to an above ball pressure within an above ball portion 356 of a bore 358 of the subsea valve 350 via a first line 360 (e.g., above ball line). The external manifold 42 may also include a below bore outlet 374 that is fluidly coupled to a below ball pressure within a below ball portion 376 of the bore 358 of the subsea valve 350 via a third line 378 (e.g., below ball line). The external manifold 42 may also include an open control inlet 380 that is fluidly coupled to an open control umbilical line 382, which may connect to a fluid source (e.g., the fluid source 36 at the platform 12, as shown in FIG. 1). Furthermore, in the illustrated embodiment, the external manifold 42 also includes a close control inlet 384 that is fluidly coupled to a close control umbilical line 386, which may connect to a fluid source (e.g., the fluid source 36 at the platform 12, as shown in FIG. 1). The open control umbilical line 382 may be fluidly coupled with (e.g., split from) the open umbilical line 38*a* and/or the close control umbilical line 386 may be fluidly coupled with (e.g., split from) the close umbilical line 38*b* (e.g., the control fluid may be provided through the open control umbilical line 382 and the open umbilical line 38*a* at the same time and/or through the close control umbilical line 386 and the close umbilical line 38*b* at the same time).

During operation of the subsea valve 350 (e.g., without pump through functionality), a piston operator 370 (and the ball 392 coupled thereto, within a valve housing 408) may be driven via delivery of the control fluid through the open umbilical line 38*a* or the close umbilical line 38*b*, as discussed above with respect to FIG. 2. For example, while the control fluid is provided via the open umbilical line 38*a*, the subsea valve 350 is in an open configuration 400 in which a ball bore 402 of the ball 392 is aligned with and is fluidly coupled to the bore 358 of the subsea valve 250 (e.g., coaxial). This is represented by box 390, which illustrates the lack of connection between the above ball inlet 354 and the below bore outlet 374 across the external manifold 42.

As best shown in FIG. 10 and represented in box 412, while the control fluid is provided via the close umbilical line 38*b* to maintain the subsea valve 350 in the closed configuration 410, the control fluid is also provided to the close control inlet 384 of the external manifold 42, and the external manifold 42 then isolates the above ball inlet 354 from the below bore outlet 374. However, when the close umbilical line 38*b* pressure is vented, a biasing member ensures that the above ball inlet 354 unidirectionally communicates with the below bore outlet 374. In this way, the external manifold 42 may assist in equalizing pressure across the ball 392 prior to issuing a command to provide the control fluid through the open umbilical line 38*a* to adjust the subsea valve 350 to the open configuration 402.

It should be appreciated that the external manifold 42 may include a cylinder and piston (e.g., split manifold piston; poppet) assembly, and movement of the piston within the cylinder is represented via the schematic illustration of the external manifold 42. Furthermore, as discussed above, the piston may include various configurations and dimensions (e.g., the same or different surface areas), which may affect the pressure differential (e.g., between the above bore pressure and the below bore pressure) that enables or blocks the pump through functionality.

It should be appreciated that the external manifold 42 may be used for pump through functionality and/or pressure balancing only when the umbilicals and the landing string are intact and are not sheared. In some embodiments, it may be desirable to also include features within the valve housing 408 that enable pump through functionality (e.g., in a typical or conventional manner) and/or pressure balancing when the umbilicals and the landing string are sheared. For example, the external manifold 42 may be used in addition to (e.g., at different time) slickline activation techniques.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. Furthermore, any of the features shown and/or described with respect to FIGS. 1-11 may be combined in any suitable manner.

What is claimed is:

1. A subsea system for use at a well, the subsea system comprising:

a subsea valve system for use in a subsea landing string, the subsea valve system comprising:

a subsea valve; and an external manifold in fluid communication with the subsea valve, wherein the external manifold comprises a cylinder, a split manifold piston within the cylinder, an above bore inlet that is configured to be exposed to an above bore pressure, a below bore inlet that is configured to be exposed to a below bore pressure, and an open chamber outlet, wherein the split manifold piston is configured to move within the cylinder to isolate the above bore inlet from the open chamber outlet to block pump through functionality while a respective force exerted on the split manifold piston by the above bore pressure is less than or equal to a respective force exerted on the split manifold piston by the below bore pressure and to fluidly couple the above bore inlet to the open chamber outlet to enable pump through functionality while the respective force exerted on the split manifold piston by the above bore pressure is greater than the respective force exerted on the split manifold piston by the below bore pressure.

2. The subsea system of claim 1, wherein the subsea valve comprises a ball valve or a lubricator valve.

3. The subsea system of claim 1, wherein the split manifold piston comprises a first surface that is configured to be acted on by the above bore pressure and a second surface that is configured to be acted on by the below bore pressure, and the first surface and the second surface comprise two different surface areas.

4. The subsea system of claim 3, wherein a respective surface area of the first surface is greater than a respective surface area of the second surface.

5. The subsea system of claim 1, wherein the subsea valve comprises a housing and an adjustable valve element positioned in the housing, and the external manifold is positioned outside the housing.

6. The subsea system of claim 1, wherein the external manifold comprises a control line inlet that is configured to be exposed to a control line pressure via an umbilical from a surface.

7. The subsea system of claim 6, wherein the control line pressure through the control line inlet is configured to drive the split manifold piston into a position within the cylinder to thereby isolate the above bore inlet from the open chamber outlet.

8. The subsea system of claim 1, wherein the subsea valve comprises a split operator piston with an open chamber that is fluidly coupled to the open chamber outlet and that ensures that the above bore pressure is contained within the open chamber and does not communicate with an open umbilical line.

9. The subsea system of claim 8, wherein the split operator piston is an annular piston that circumferentially surrounds an adjustable valve element.

10. The subsea system of claim 1, wherein the subsea valve comprises a split operator piston comprising a first portion and a second portion, an open chamber between the first portion and the second portion along a vertical axis of the subsea valve, and the open chamber outlet is fluidly coupled to the open chamber.

11. An external manifold configured to provide pump through functionality for a subsea valve, the external manifold comprising:

a cylinder;

a manifold piston within the cylinder;

an above bore inlet that is configured to be exposed to an above bore pressure in a first portion of a bore, wherein the first portion of the bore is located between the subsea valve and a platform at a sea surface;

a below bore inlet that is configured to be exposed to a below bore pressure in a second portion of the bore, wherein the second portion of the bore is located between the subsea valve and a well; and an open chamber outlet, wherein the manifold piston is configured to move within the cylinder to isolate the open chamber outlet while a respective force exerted on the manifold piston by the above bore pressure is less than or equal to a respective force exerted on the manifold piston by the below bore pressure and to enable a fluid flow to the open chamber outlet while the respective force exerted on the manifold piston by the above bore pressure is greater than the respective force exerted on the manifold piston by the below bore pressure.

12. The external manifold of claim 11, wherein the manifold piston is configured to move within the cylinder to isolate the above bore inlet from the open chamber outlet while the respective force exerted on the manifold piston by the above bore pressure is less than or equal to the respective force exerted on the manifold piston by the below bore pressure and to enable the fluid flow from the above bore inlet to the open chamber outlet while the respective force exerted on the manifold piston by the above bore pressure is greater than the respective force exerted on the manifold piston by the below bore pressure.

13. The external manifold of claim 11, wherein the manifold piston comprises a first portion and a second portion that move independently within the cylinder.

14. The external manifold of claim 12, wherein the external manifold comprises a control line inlet that is configured to receive a control line pressure via an umbilical from the surface.

15. The external manifold of claim 11, wherein the manifold piston comprises a first surface that is configured to be acted on by the above bore pressure and a second surface that is configured to be acted on by the below bore pressure, and the first surface and the second surface comprise two different surface areas.

16. A subsea valve system for use in a subsea landing string, the subsea valve system comprising:

a subsea valve comprising a housing and an adjustable valve element that is configured to function between an open position and a closed position; and an external manifold positioned outside the housing and in fluid communication with the subsea valve, wherein the external manifold is configured to provide pump through functionality for the subsea valve by fluidly coupling an above bore pressure to an open chamber of the subsea valve while the above bore pressure is greater than a below bore pressure;

wherein the external manifold comprises a cylinder, a manifold piston within the cylinder, an above bore inlet that is configured to be exposed to the above bore pressure, a below bore inlet that is configured to be exposed to the below bore pressure, and an open chamber outlet that is configured to be fluidly coupled to the above bore pressure while the above bore pressure is greater than the below bore pressure to thereby provide the pump through functionality for the subsea valve.

17. The subsea valve system of claim 16, wherein the manifold piston comprises a first surface that is configured to be acted on by the above bore pressure and a second surface that is configured to be acted on by the below bore pressure, and the first surface and the second surface comprise two different surface areas.

18. The subsea valve system of claim 16, wherein the subsea valve comprises an operator piston that is coupled to the adjustable valve element, an open control pressure from an open umbilical is configured to drive the operator piston to adjust the adjustable valve element to the open position, and a close control pressure from a close umbilical is configured to drive the operator piston to adjust the adjustable valve element to the closed position.

19. The subsea valve system of claim 18, wherein the operator piston comprises a first portion and a second portion, and the open chamber that is positioned between the first portion and the second portion of the operator piston.

* * * * *